US005217168A

United States Patent [19]

Svendsen

[11] Patent Number: 5,217,168

[45] Date of Patent: Jun. 8, 1993

[54] AIR CAP FOR PAINT SPRAY GUN

[75] Inventor: John M. Svendsen, Corcoran, Minn.

[73] Assignee: Wagner Spray Tech Corporation, Minneapolis, Minn.

[21] Appl. No.: 735,795

[22] Filed: Jul. 30, 1991

[51] Int. Cl.[5] ..... 239 300; B05B 7/12

[52] U.S. Cl. ..... 239/297

[58] Field of Search ..... 239/294, 296, 290, 297, 239/300, 301, 390–393, 121

[56] References Cited

U.S. PATENT DOCUMENTS

| | | | |
|---|---|---|---|
| 1,752,922 | 4/1930 | Mueller | 239/301 X |
| 1,784,964 | 12/1930 | Jenkins | 239/294 |
| 1,797,209 | 3/1931 | Bramsen et al. . | |
| 1,873,625 | 8/1932 | Munz | 239/301 |
| 1,919,153 | 7/1933 | Andrews | 239/290 X |
| 1,950,779 | 3/1934 | Bramsen | 91/45 |
| 1,962,911 | 6/1934 | Roselund | 239/301 |
| 2,602,004 | 7/1952 | Faktor | 299/86 |
| 2,670,239 | 2/1954 | Ditch | 299/86 |
| 2,888,207 | 5/1959 | Sykes | 239/301 |
| 4,221,339 | 9/1980 | Yoshikawa | 7/10 |
| 4,273,287 | 6/1981 | Huber | 7/8 |
| 4,531,675 | 7/1985 | Muck | 1/26 |
| 4,537,357 | 8/1985 | Culbertson et al. | 1/28 |
| 4,651,932 | 3/1987 | Huber et al. | 5/2 |
| 4,744,518 | 5/1988 | Toth | 1/28 |
| 4,754,923 | 7/1988 | Matusita et al. | 239/68 |
| 4,759,502 | 7/1988 | Pomponi et al. | 239/8 |
| 4,915,303 | 4/1990 | Hufgard | 1/28 |
| 4,948,053 | 8/1990 | Hufgard | 1/26 |
| 5,090,623 | 2/1992 | Burns et al. | 239/300 X |
| 5,102,051 | 4/1992 | Smith et al. | 239/301 X |

FOREIGN PATENT DOCUMENTS 248462 12/1963 Australia .

*Primary Examiner*—Andres Kashnikow
*Assistant Examiner*—Kevin P. Weldon
*Attorney, Agent, or Firm*—Faegre & Benson

[57] ABSTRACT

An air cap for a paint spray gun has air venting passages to relieve back pressure to an air source when the air flow through shaping passages for controlling the shape of the atomized paint spray pattern is blocked and also has a plurality of inwardly directed centering flanges for concentrically aligning the air cap on an associated paint spray nozzle.

13 Claims, 3 Drawing Sheets

AIR CAP FOR PAINT SPRAY GUN

SUMMARY OF THE INVENTION

This invention relates to an air cap for a paint spray gun having forwardly opening air venting passages angled outwardly from a paint passage located centrally with respect to the air venting passages. The venting passages allow air to escape to reduce back pressure to the air supply when air is blocked from flowing through a set of spray pattern shaping passages. It has been found desirable to relieve back pressure when paint spray guns are operated from portable turbine or an type equipment to prevent undesired operating conditions for the turbine or fan. In particular, if the outlet of such a turbine air supply is blocked or restricted (with the consequent increase in back pressure) it has been observed that the turbine will overspeed and, because the airflow is often used to cool the turbine motor, overheating may also result.

In the past, HVLP (High Volume Low pressure) spray guns with shaping passages directed inwardly toward the paint passage allowed back pressure to build up on the air supply source, typically a fan powered by a motor, when the shaping passages were blocked to produce a circular spray pattern. Such back pressure reduces the efficiency of the fan motor and increases wear on the motor.

An example of blockable shaping passages is shown in Bramsen U.S. Pat. No. 1,950,779. Back pressure accumulates in the Bramsen apparatus when a needle valve closes, blocking off the shaping or supplemental air passages to produce a circular paint spray pattern. Another such arrangement is shown in Ditch U.S. Pat. No. 4,670,239. When the valve of Ditch closes against its corresponding orifice, air to the passages is blocked, and a build up of back pressure to the air source is created. The spray pattern adjusting valve of Matusita et al. U.S. Pat. No. 4,754,923 performs much the same air blocking function with a corresponding build up of back pressure.

It is known to use a blocking plate behind an air cap, and to use an air cap having shaping passages disposed along a diameter of the air cap. Because the blocking plate typically has elongated vertical and horizontal extensions of a central aperture, it is further known to position the air cap with the primary shaping passages disposed diagonally to block the primary shaping passages to produce a circular paint spray pattern and to position the air cap vertically or horizontally to produce a horizontally or vertically compressed pattern. The blocking plate opening is shaped such that when the air cap is vertically or horizontally oriented with respect to the spray gun, the air cap passages line up with the opening to permit air flow through the shaping passages. When the air cap is diagonally oriented, the passages are no longer aligned with extensions of the opening in the blocking plate. Known blocking plates have a cruciform opening to regulate air flow.

In the present invention four venting passages are added to the air cap which preferably has two conventional primary shaping passages. The back of the air cap is disposed against this blocking plate. In the present invention the air cap is rotatable about a central passage therein with the central passage remaining aligned with the central aperature of the blocking plate. In the practice of the present invention, rotation of the air cap to block the primary shaping passages by positioning them diagonally aligns the air cap venting passages with the blocking plate aperture or opening, thus permitting air flow through the venting passages to relieve back pressure to the air supply which would otherwise result.

DETAILED DESCRIPTION OF THE INVENTION

Figure 1:
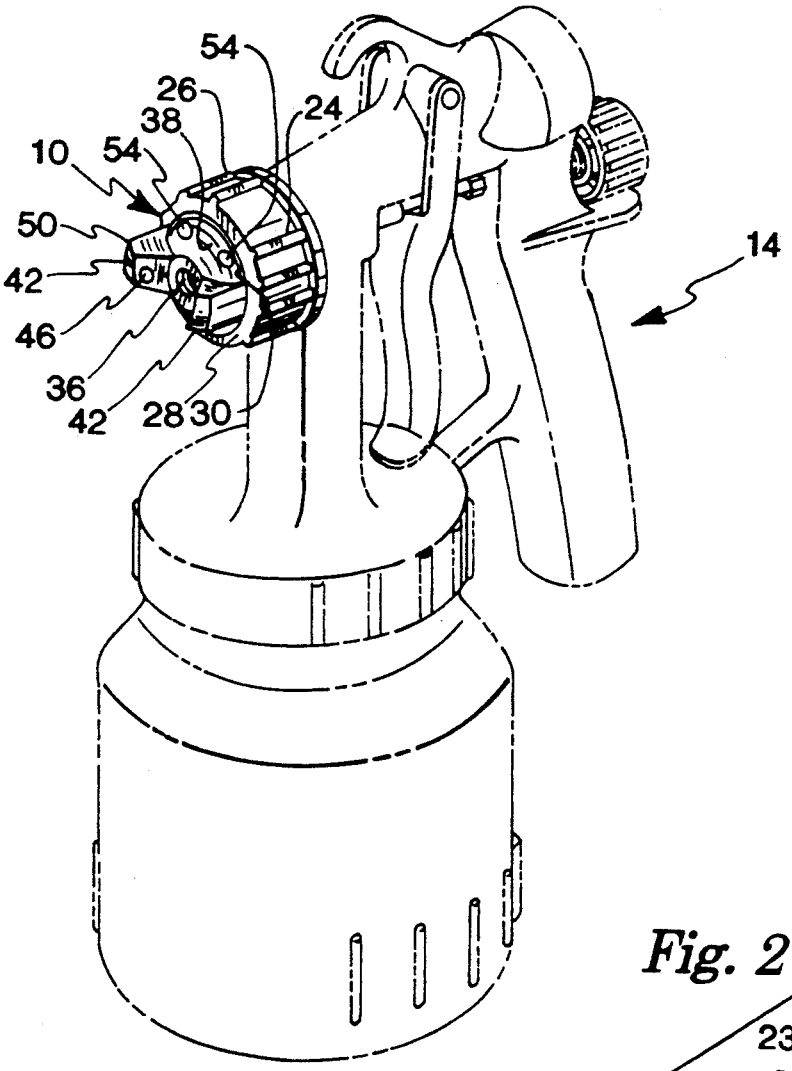
FIG. 1 is a perspective view of the air cap and retaining ring with an associated paint spray gun shown in phantom.
Figure 2:
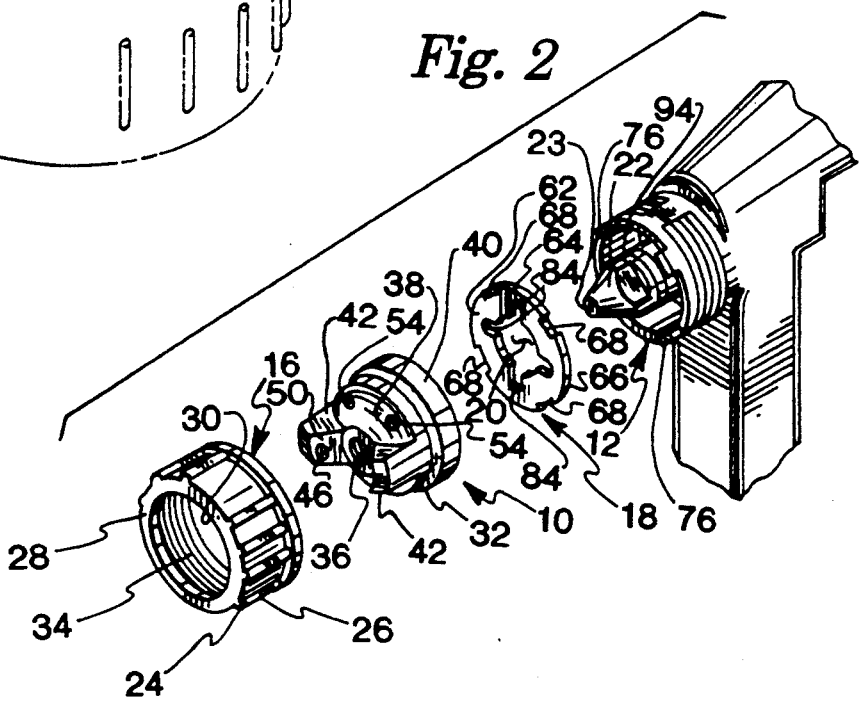
FIG. 2 is an exploded perspective view of the air cap, blocking plate, retaining ring and fragmentary view of a paint spray gun showing the gun nozzle.
Figure 3:
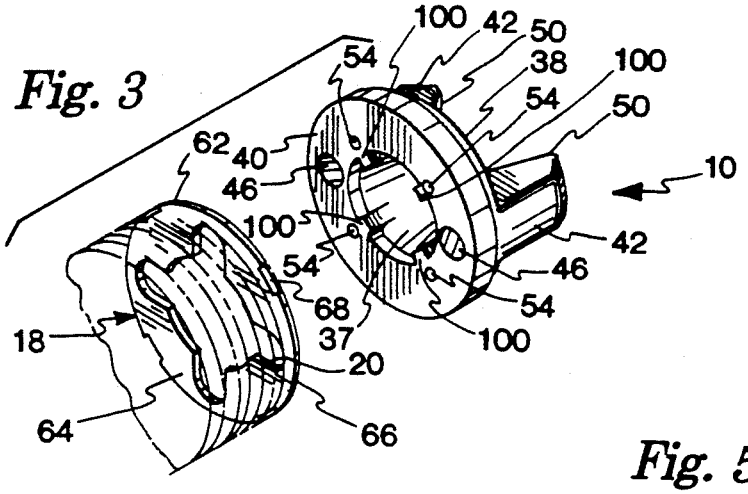
FIG. 3 is an exploded perspective view of the back of the air cap and the blocking plate with the forward surface of the spray gun shown in phantom.

Referring to FIG. 1, a preferred embodiment of an air cap 10 of the present invention is shown in position on a spray gun 14 shown in phantom. Referring also to FIG. 2, a blocking plate 18 having an opening 20 is located between air cap 10 and a forward surface 12 of gun 14. Gun 14 has a nozzle 22 with a central aperture closed by a needle valve 23. The air cap 10 and blocking plate 18 are retained on forward surface 12 by a cylindrical retaining ring 16 having a threaded axial bore 34 as shown in FIG. 2. The cylindrical retaining ring 16 may have axial ribs 24 on an exterior surface 26. The retaining ring 16 also has a radially inwardly projecting lip 28 on the retaining ring 16. It is to be understood that lip 28 forms an aperture 30 having a diameter less than bore 34.

Figure 7:
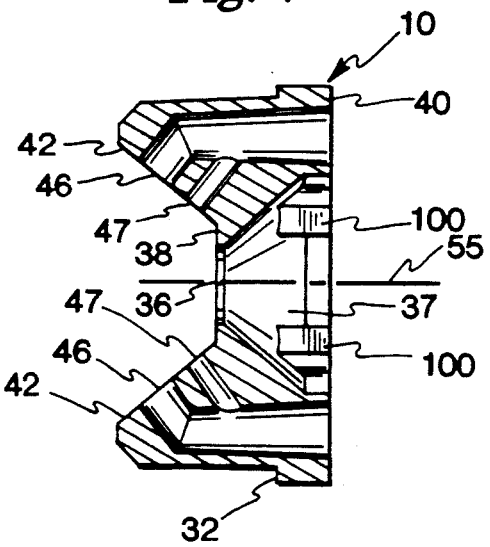
FIG. 7 is a section view taken along line 7—7 of FIG. 8.

The air cap 10 preferably has an annular retaining rim 32 with a diameter less than bore 34 of retaining ring 16 and greater than the diameter of aperture 30 formed by lip 28 such that when retaining ring 16 is threaded onto the forward surface 12 over the retaining rim 32, lip 28 retains air cap 10 and blocking plate 18 on forward surface 12. The air cap 10 also has a central passage 36 communicating between a front surface 38 and a back surface 40 of the air cap 10. Air cap 10 has two diametrically opposing horns 42 extending from front surface 38. Each horn 42 has a sloped surface 50 extending outwardly away from the central passage 36. Each sloped surface 50 defines a radially inwardly aimed primary spray shaping passage 46, as may be seen most clearly in in FIG. 7. In addition, each sloped surface 50 may define a radially aligned inwardly aimed supplemental shaping passage 47. Each supplemental shaping passage 47 preferably has a smaller diameter than the primary shaping passages 46. Both the supplemental shaping passage 46 and the primary shaping passages 46 communicate with the back surface 40 of the air cap, and the supplemental shaping passages 47 are preferably located radially inwardly of the primary shaping passages 46.

Referring now to FIGS. 3–7, the air cap 10 also preferably has four centering flanges 100 equidistantly disposed from each other within central passage 36. These centering flanges 100 are adapted to guide air cap 10 on an outer cylindrical surface 94 of the nozzle 22 to maintain concentricity of central passage 36 with respect to the nozzle 22, thus providing uniform air flow around the nozzle 22. Flanges 100 project radially inwardly and define a pilot circle 102 (see FIG. 5) having substantially the same diameter (with sliding clearance) as the cylindrical portion 94 of nozzle 22 (see FIG. 2). Each flange 100 preferably has an arcuate surface or profile 104 at pilot circle 102.

Figure 8:
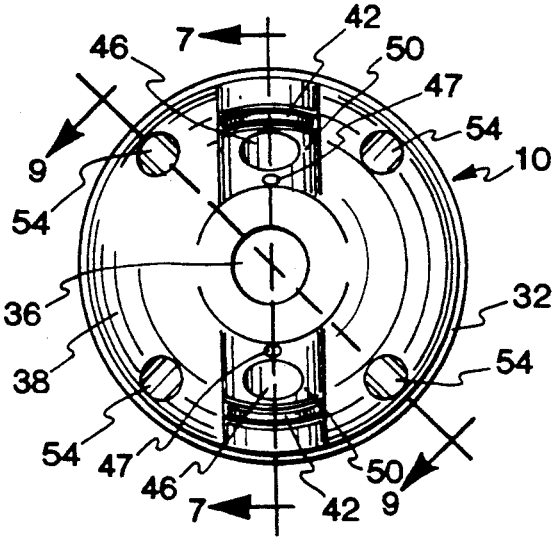
FIG. 8 is a front elevation view of the air cap.
Figure 9:
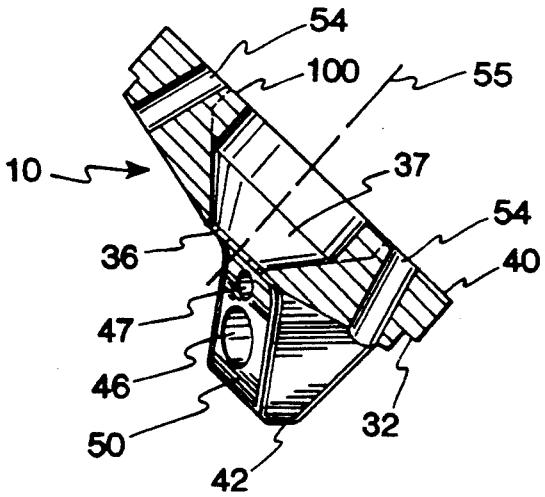
FIG. 9 is a section view taken along line 9—9 of FIG. 8.

Referring now also to FIG. 8, air cap 10 also has four venting passages 54 disposed equidistantly from each other around the central passage 36, and preferably equidistantly spaced about horns 42. The venting passages 54 also communicate with the back surface 40 of the air cap 10 as shown most clearly in FIG. 9. The venting passages 54 are preferably angled outwardly at an angle of 15° from an axis 55 of the air cap 10 to prevent air venting passages 54 from interfering with the spray pattern formed by paint exiting nozzle 22 and air exiting central aperture 36. It is to be understood that other angles may be used and still be within the scope of the present invention provided that the air escaping from the venting passages does not interfere with the paint spray pattern.

Referring now to FIGS. 2–6, the generally circular blocking plate 18 has a central opening 20. A cruciform shape is preferred for the opening 20. The opening 20 communicates between a first side 62 and a second side 64 of the blocking plate 18.

The other edge 66 of the blocking plate 18 preferably defines four positioning notches 68 evenly spaced around the outer circumference of the blocking plate 18. The positioning notches 68 are adapted to interlock with four forwardly extending locking prongs 76 preferably evenly spaced around the forward surface 12 to positively locate and prevent rotation of the blocking plate 18 with respect to forward surface 12.

In operation, air flow is directed through four branches 84 of opening 20.

Figure 5:
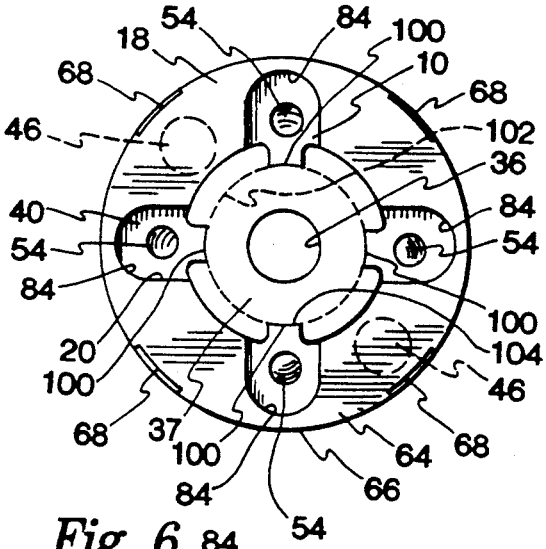
FIG. 5 is a rear elevation view of the blocking plate and air cap with the shaping passages diagonally disposed.
Figure 4:
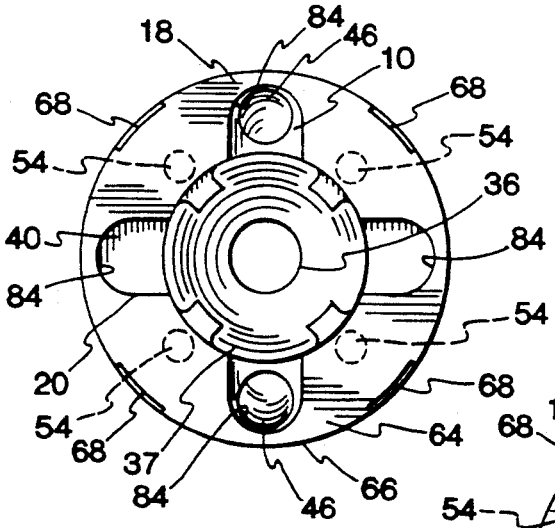
FIG. 4 is a rear elevation view of the blocking plate and air cap with the shaping passages vertically disposed.
Figure 6:
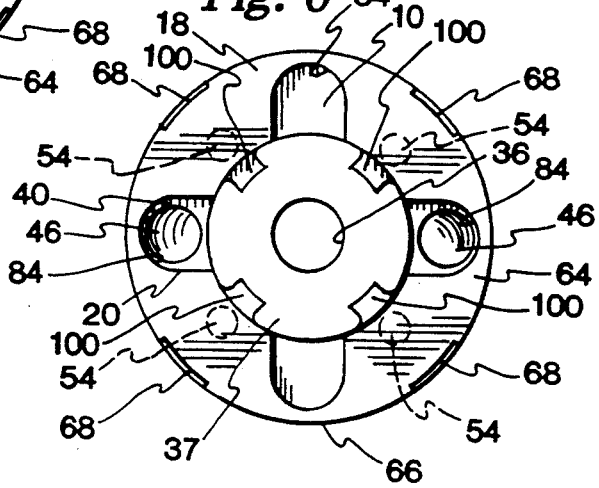
FIG. 6 is a rear elevation view of the blocking plate and air cap with the shaping passages horizontally disposed.

The venting passages 54 are disposed to communicate with the back surface 40 of the air cap 10 such that each of the four venting passages 54 is simultaneously alignable with one of the four branches 84 of the cruciform opening 20 through rotation of the air cap 10 to a first position as shown in FIG. 5. The primary shaping passages 46 are blocked by plate 18 in this position. Rotation of the air cap 10 to either of a second position or a third position as shown in FIGS. 4 and 6, respectively, aligns the primary shaping passages 46 with branches 84. Air flow through the venting passages 54 is blocked by plate 18 when the air cap 10 is disposed in either the second or third position. Thus it may be seen that air flow is maintained in each of the first, second and third positions. In the first position, air flow is directed through the venting passages 54 which relieves back pressure to the air source while the primary shaping passages 46 are blocked. In the second and third positions, venting passages 54 are blocked while the primary shaping passages 46 conduct air (to alter the shape of a paint spray pattern) relieving back pressure to the air source.

Although the present invention has been described with reference to preferred embodiments, workers skilled in the art will recognize that changes may be made in form and detail without departing from the spirit and scope of the invention.

What is claimed is:

1. An air cap system for a paint spray gun comprising:

(a) An air cap including:

(1) a central passage coaxially aligned with a central longitudinal axis of the air cap, (2) at least one paint spray shaping passage in the air cap configured and arranged for directing a flow of pressurized air against a stream of atomized paint discharged from the central passage so as to alter the shape of the paint spray, and, (3) at least one venting passage in the air cap configured and arranged so as to be ineffective for directing a flow of pressurized air against a stream of atomized paint discharged from the central passage so as to alter the shape of the paint spray, and (b) a blocking means effective for blocking air flow through the paint shaping passage while permitting air flow through the venting passage when in a first position and permitting air flow through the paint shaping passage while blocking air flow through the venting passage when in a second position; the blocking means operable for directing air flow between the paint shaping passage and the venting passage independently of the flow of a fluid through the central passage.

2. The air cap system of claim 1 wherein the venting passage is angled away from the longitudinal axis of the air cap.

3. The air cap system of claim 1 comprising at least two venting passages.

4. The air cap system of claim 1 comprising at least four venting passages.

5. The air cap system of claim 4 wherein the venting passages are equidistantly spaced within a concentric circle around the central passage.

6. The air cap system of claim 5 wherein the air cap is rotatably about the longitudinal axis of the air cap.

7. The air cap system according to claim 6 wherein the blocking means comprises at least a blocking plate positioned upstream from the air cap with at least one opening, and the blocking plate and air cap are rotatable relative to one other for aligning the opening through the blocking plate with the venting passage through the air cap in a first position and aligning the opening through the blocking plate with the paint shaping passages through the air cap in a second rotated position.

8. The air cap system of claim 7 wherein the blocking plate opening is a cruciform shaped aperture.

9. An air cap system for a paint spray gun comprising:

(a) A self-centering air cap including at least:

(1) a central passage concentric with a longitudinal axis of the air cap, (2) at least two paint spray shaping passages configured and arranged for directing a flow of pressurized air against a stream of atomized paint discharged from the central passage so as to alter the shape of the paint spray, (3) at least one venting passage in the air cap configured and arranged so as to be ineffective for directing a flow of pressurized air against a stream of atomized paint discharged from the central passage so as to alter the shape of the paint spray, and (4) a plurality of centering flanges projecting radially inward from an interior surface of the air cap into the central passage; the centering flanges adapted to (i) guide the air cap onto a cylindrical portion of a paint spray nozzle positioned within the central passage while providing a gap between the interior surface of the air cap and the exterior surface of the nozzle intermediate adjacent centering flanges, and (ii) maintaining concentric alignment of the nozzle and the air cap when the air cap is rotated relative to the nozzle, and (b) a blocking means positionable relative to the air cap as between a first position wherein air flow through the paint shaping passage is blocked while air flow through the venting passage is permitted; and a second position wherein air flow through the paint shaping passage is permitted while air flow through the venting passage is blocked; the blocking means operable for directing air flow between the paint shaping passage and the venting passage independently of the flow of a fluid through the central passage.

10. A method for altering the spray pattern of atomized paint sprayed from a paint spray gun while maintaining a substantially constant level of back pressure within the air flow path of the paint spray gun comprising the step of:

(a) positioning an air cap, located proximate the distal end of a paint spray nozzle, relative to a blocking means, located upstream from the air cap, as between a first position and a second position wherein, (i) the air cap is in sealed fluid communication with an air flow path within the paint spray gun in both the first and second positions, (ii) the first position permits air flow through paint shaping passages in the air cap so as to shape atomized paint sprayed through a central passage in the air cap while blocking air flow through venting passages in the air cap, and (iii) the second position permits air flow through the venting passages in the air cap so as to vent pressurized air from the paint spray gun without shaping atomized paint sprayed through the central passage in the air cap while blocking air flow through the paint shaping passages in the air cap.

11. The method of claim 10 wherein the air cap and blocking means are positioned relative to one another between the first and second positions by rotating the air cap relative to the rotatably stationary blocking means.

12. The method of claim 11 wherein the air cap and blocking means are positioned relative to one another between the first and second positions by rotating the air cap relative to the rotatably stationary blocking means from the first position to the second position.

13. The method of claim 1 wherein the air cap and blocking means are positioned relative to one another between the first and second positions by rotating the air cap relative to the rotatably stationary blocking means from the first position to the second position.

* * * * *

UNITED STATES PATENT AND TRADEMARK OFFICE

CERTIFICATE OF CORRECTION

PATENT NO. : 5,217,168

DATED : June 8, 1993

INVENTOR(S) : Svendsen

It is certified that error appears in the above-identified patent and that said Letters Patent is hereby corrected as shown below:

In Col. 6, Line 26, delete "1" and insert therefor --11--.

Signed and Sealed this

Twelfth Day of April, 1994

Bruce Lehman

*Attest:*

BRUCE LEHMAN

*Commissioner of Patents and Trademarks*

*Attesting Officer*

UNITED STATES PATENT AND TRADEMARK OFFICE

CERTIFICATE OF CORRECTION

PATENT NO. : 5,217,168

DATED : JUNE 8, 1993

INVENTOR(S) : JOHN M. SVENDSEN

It is certified that error appears in the above-identified patent and that said Letters Patent is hereby corrected as shown below:

Column 1, line 13, "an" should be --fan--.

Column 2, line 63, delete the first "in".

Column 2, line 68, "passage" should read --passages--.

Column 2, line 68, "46" should be --47--.

Column 4, line 44, "rotatably" should be --rotatable--.

Signed and Sealed this

Twenty-ninth Day of November, 1994

*Attest:*

Bruce Lehman

BRUCE LEHMAN

*Attesting Officer*

*Commissioner of Patents and Trademarks*